US009140040B2

(12) United States Patent
Fu

(10) Patent No.: US 9,140,040 B2
(45) Date of Patent: Sep. 22, 2015

(54) LATCH ASSEMBLY WITH AUTOMATIC RETURNING BOLT

(71) Applicants: LITE-ON ELECTRONICS (GUANGZHOU) LIMITED, Guangzhou (CN); LITE-ON TECHNOLOGY CORPORATION, Taipei (TW)

(72) Inventor: Ping-Kun Fu, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 227 days.

(21) Appl. No.: 13/874,502

(22) Filed: May 1, 2013

(65) Prior Publication Data

US 2014/0175811 A1 Jun. 26, 2014

(30) Foreign Application Priority Data

Dec. 21, 2012 (TW) ..... 101148962 A

(51) Int. Cl.
*E05C 1/02* (2006.01)
*E05C 1/04* (2006.01)

(52) U.S. Cl.
CPC ..... *E05C 1/04* (2013.01); *Y10T 292/1001* (2015.04)

(58) Field of Classification Search
CPC ..... E05C 1/04; E05C 1/10; E05C 17/48; E05B 15/101
USPC ..... 292/179, 137, 163, 166, 168, 168.18, 292/174, 150, 302
See application file for complete search history.

(56) References Cited

U.S. PATENT DOCUMENTS 1,364,749 A * 1/1921 Graybeal ..... 292/150
2,518,207 A * 8/1950 Wagner ..... 292/175

* cited by examiner

*Primary Examiner* — Mark Williams
(74) *Attorney, Agent, or Firm* — Li & Cai Intellectual Property (USA) Office

(57) ABSTRACT

A latch assembly with an automatic returning bolt includes a chassis, a bolt and an elastic element. The chassis has a pair of supporting boards and a guiding board located on one side of the pair of supporting boards. The guiding board is formed with a guiding slot. Each supporting board is formed with a receiving hole. The bolt has a main shaft, a lateral-guiding post and a restricting portion disposed on a periphery of the main shaft. The main shaft is slidably passed through the receiving holes of the supporting boards. The lateral-guiding post is slidably disposed in the guiding slot for limiting a stroke distance thereof. The elastic element is disposed between the restricting portion and one of the supporting boards, and constantly pushes one end of the main shaft to protrude outside the other supporting boards to lock a locking piece.

14 Claims, 4 Drawing Sheets

LATCH ASSEMBLY WITH AUTOMATIC RETURNING BOLT

BACKGROUND OF THE INVENTION

1. Field of the Invention

The present disclosure is related to a latch assembly with an automatic returning bolt. In particular, the present disclosure relates to a latching assembly having a bolt to lock an enclosure, or called casing, such as a computer housing, wherein the bolt can automatically return by elastic force of an elastic element.

2. Description of Related Art

Electronic or electricity devices usually have various chassis for protecting the related equipment. The chassis usually has a cover which can be opened for assembly, checking or expanding equipment.

For example, a chassis for desktop computer usually has a side cover. After the side cover is opened and the related work is finished, it is usually closed and locked to the chassis itself by a bolt. However, some conventional bolt cannot return to the original position, and the operating user needs to push the bolt to the original position after the side cover is closed. If the bolt is unintentionally not returned to the original position, the chassis is not really closed and the side cover may be departed from the chassis and cause an accident.

Therefore, it is desirable to propose a latch assembly with automatic returning bolt to overcome the above-mentioned problems.

SUMMARY OF THE INVENTION

The instant disclosure provides a latch assembly with an automatic returning bolt, which not only can return automatically to an original condition, but also has a simplified structure overall and a reduced number of elements, to reduce the manufacturing cost and assembly cost.

In order to achieve the above objectives, the instant disclosure provides a latch assembly with an automatic returning bolt, which includes a chassis, a bolt and an elastic element. The chassis has a pair of supporting boards and a guiding board laterally arranged with respect to the pair of supporting boards on one side thereof cooperatively defining a bolt-mounting seat. Each of the supporting boards is respectively formed with a receiving hole correspondingly positioned to cooperatively define a bolt-shifting space (S) there-between that has a bolt-travel axis The guiding board is slotted with a guiding slot extending substantially alignigly with the bolt-travel axis. The bolt has a main shaft, a lateral-guiding post, and a restricting portion laterally arranged on a periphery of the main shaft. The main shaft is installed in the bolt-shifting space slidably along the bolt-travel axis. When the main shaft slides in the bolt-shifting space, the restricting portion is slidably arranged in the guiding slot, so that a travel range of the bolt is limited. The elastic element is sleevingly disposed over the main shaft of the bolt concurrently installed between and in contact with the restricting portion of the bolt and one of the supporting board of the chassis during the installation of the bolt, for providing a biasing force on the bolt, so as to keep the main shaft thereof protruding from the other supporting board not in contact there-with in a default configuration.

Thus, the instant disclosure has the following advantages. The present disclosure has the bolt of simplified structure cooperated with a spring so as to provide the bolt with an automatic returning function. The total number of elements is reduced. The assembly time and labor cost are saved.

For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

Figure 1:
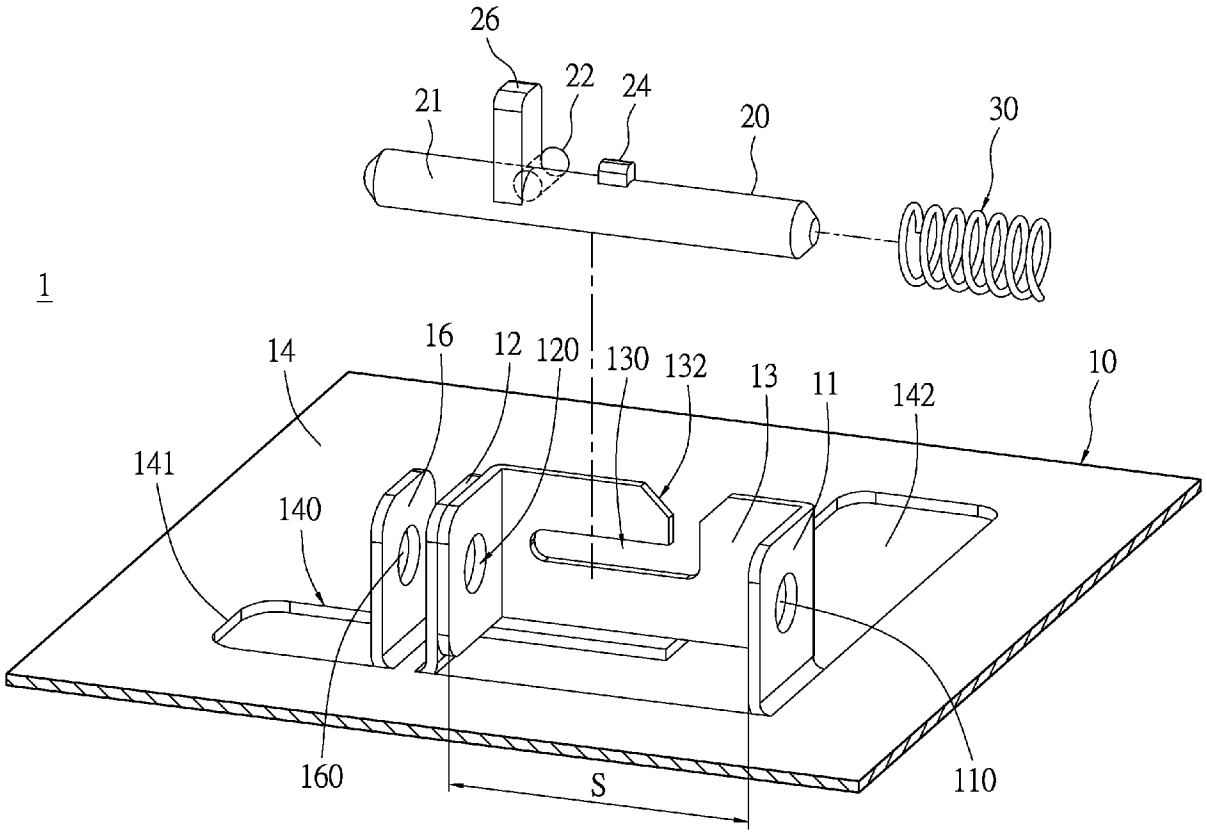
FIG. 1 is an exploded perspective view of a latch assembly with automatic returning bolt according to the present disclosure.
Figure 2:
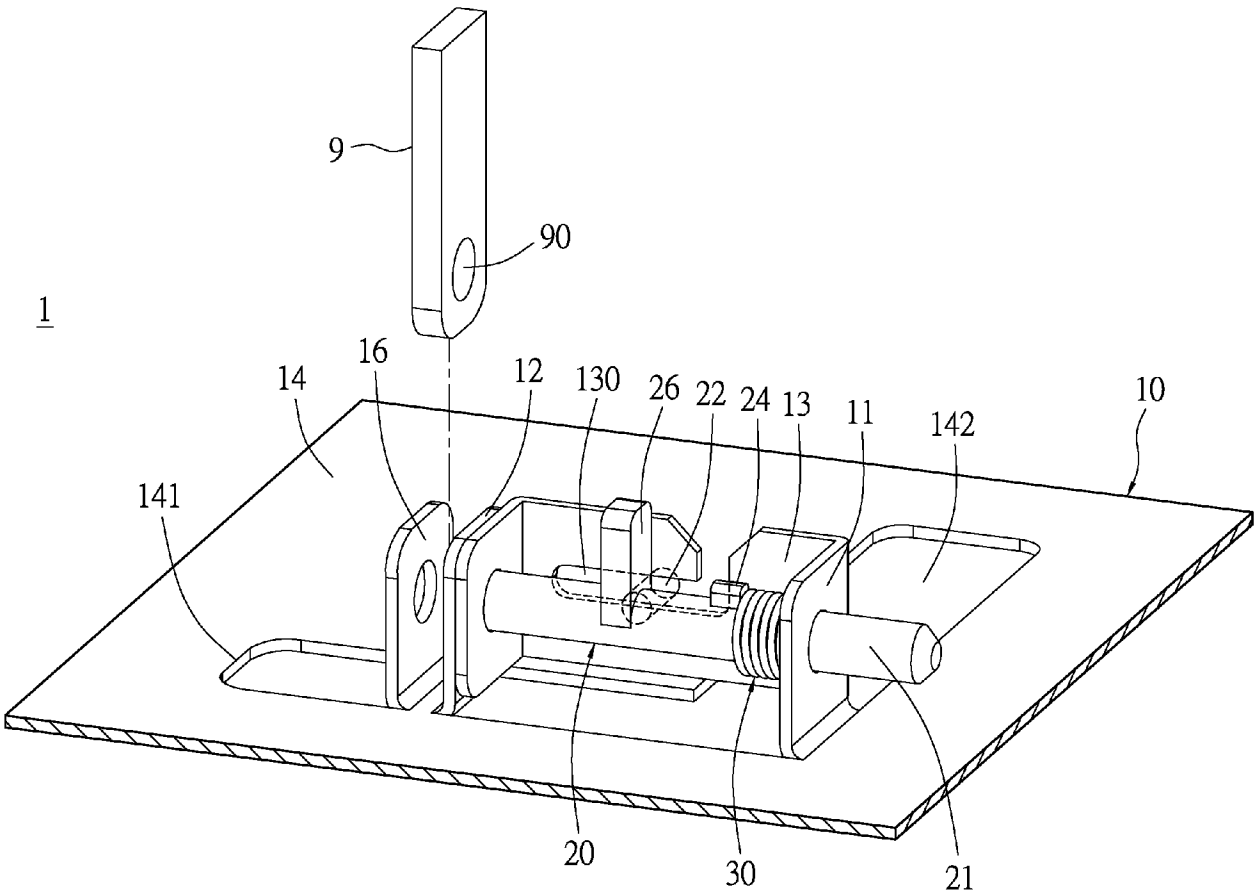
FIG. 2 is an assembled perspective view of a latch assembly with automatic returning bolt according to the present disclosure.

Please refer to FIGS. 1 and 2, which are exploded and assembled perspective views of a latch assembly with automatic returning bolt according to the present disclosure; according to the present disclosure. As shown in FIG. 1, the present disclosure provides a latch assembly with automatic returning bolt 1, or shortly called a latch assembly with bolt 1, including a chassis 10, a bolt 20 and an elastic element 30. The bolt 20 is slidably mounted on the chassis 10, and protrudes outside one side of the chassis 10 to lock a piece subjected for locking 9, or called as subjected-lock piece, and automatically back away by the elastic element 30. The present disclosure can be applied on any device having chassis. The following introduces details of the above-mentioned elements.

Please refer to FIG. 1. The chassis 10 of this embodiment has a pair of supporting boards 11, 12, and a guiding board 13 laterally arranged with respect to the pair of supporting boards 11, 12 on one side thereof cooperatively defining a bolt-mounting seat. The guiding board 13 is slotted with a guiding slot 130. The pair of supporting boards 11, 12 is parallel to each other, and each supporting board is respectively formed with a receiving hole 110, 120 correspondingly positioned to cooperatively define a bolt-shifting space S there-between that has a bolt-travel axis. To distinguish the pair of the supporting boards 11, 12, they are named as a first supporting board 11 and a second supporting board 12. In this embodiment, the guiding slot 130 is substantially L-shaped. The receiving holes 110, 120 of the pair of supporting boards 11, 12 are mutually corresponding on their position. The guiding slot 130 is substantially parallel to the bolt-shifting space S, in other word, extending substantially alignigly with the bolt-travel axis.

In this embodiment, the chassis 10 further includes a blocking board 16 disposed at an outer side of the second supporting board 12. Between the blocking board 16 and the second supporting board 120, a space is defined to receive the piece subject for locking 9. The blocking board 16 further forms an outer receiving hole 160. The outer receiving hole 160 corresponds to the receiving hole 120 of the second supporting board 12, as shown in FIG. 2. The main shaft 21 is usually protruded outside the receiving hole 120 of the supporting board 12 which has no contact relationship related to the elastic element 30, and passes through the outer receiving hole 160 to lock the piece subject for locking 9.

The chassis 10 preferably is made of a metallic board by punching and bending. In this embodiment, the chassis 10 includes a base board 14. The pair of supporting boards 11, 12 and the guiding board 13 are integrally formed through punching a portion of the base board 14 and bending the punched portion thereof toward the bolt-shifting space S, so that forming the bolt-mounting seat from the base board 14. The blocking board 16 can be bent from a part of the base board 14. The blocking board 16 is near to and parallel to the second supporting board 120. The chassis 10 is an integral structure, so that it has no need for additional assembly. However, the above-mentioned embodiment is just a preferred embodiment of the present disclosure and is not limited thereto. For example, the supporting boards 11, 12 can be assembled with the guiding board 13 separately.

The following introduces a detailed punched structure of the chassis 10. The base board 14 is formed with an L-shaped punching slot 140. The L-shaped punching slot 140 has a first punching slot 141 formed under the main shaft 20, and a second punching slot 142 perpendicular to the first punching slot 141. The pair of supporting boards 11, 12 is distinguished into a first supporting board 11 disposed at a turning place of the L-shaped punching slot 140 and contacting the elastic element 30, and a second supporting board 12 disposed above the first punching slot 141.

The process of punching the chassis 10 includes the following steps. First, to preserve a portion of the base board 14 located in the region of the second punching slot 142. To make a bottom edge of the first supporting board 11 connected the base board 14 without breaking, and the other edges are cut without connecting to the base board 14. Then, the first supporting board 11 and the guiding board 13 are formed. At the same time, the process also forms the receiving hole 110 of the first supporting board 11 and the guiding slot 130 of the guiding board 13. Then, the first supporting board 11 and the guiding board 13 are bent upward and upright relative to the base board 14, in which the guiding board 13 is bent toward the first punching slot 141. During the above-mentioned punch process, a portion of the base board 14 located in the first punching slot 141 is also cut to form the second supporting board 12 and the blocking board 16. Simultaneously, the receiving hole 120 of the second supporting board 12 and the outer receiving hole 160 of the blocking board 16 are formed on the chassis 10. The second supporting board 12 is bent upright from the base board 14, and the blocking board 16 is bent upright relative to the base board 14. The blocking board 16 is cut and bent from a portion of the base board 14, and is located above the first punching slot 141.

In this embodiment, the pair of supporting boards 11, 12 and the guiding board 13 are arranged in an U-shape, and are substantially perpendicular to the base board 14. The guiding board 13 is extended and bent from one side edge of the first supporting board 11 toward the first punching slot 141, then further has a distal end bent and overlap the second supporting board 12.

Refer to FIG. 1. The bolt 20 has a main shaft 21, a lateral-guiding post 22 connected to the main shaft 21, and a restricting portion 24 laterally arranged on a periphery surface of the main shaft 21. As shown in FIG. 2, the main shaft 21 is slidably passed through the receiving holes 110, 120 of the pair of supporting boards 11, 12 linearly along the longitudinal direction of the main shaft 21, and slides in the bolt-shifting space S along the bolt-travel axis. In this embodiment, the lateral-guiding post 22 is outwardly extended from a periphery of the main shaft 21, and is substantially perpendicular to the main shaft 21. When the main shaft 21 slides in the bolt-shifting space S, the restricting portion 24 is slidably arranged in the guiding slot 130 for limiting a travel range of the bolt 20. Therefore, the main shaft 21 is restricted along a linear direction and moves without rotation. This embodiment utilizes the guiding slot 130 of the guiding board 13 to restrict the travel range of the lateral-guiding post 22 of the main shaft 21. The bolt 20 of this embodiment preferably is formed integrally.

As shown in FIG. 1, this embodiment further includes a handle 26 connected to the main shaft 21, so that user can pull the bolt 20 to an unlocking position. The handle 26 is disposed beside the guiding board 13 and extended away from the chassis 10. The handle 26 is proximate to the lateral-guiding post 22 and is substantially perpendicular to the lateral-guiding post 22. The handle 26 is arranged upward and outside, thus a user can conveniently move the bolt 20. However, a user can also pull the restricting portion 24 to move the bolt 20. In this embodiment, the handle 26 can be omitted.

Refer to FIG. 2. The elastic element 30 is sleevingly disposed over the main shaft 21 of the bolt 20, and is concurrently installed between and in contact with the restricting portion 24 of the bolt 20 and one of the supporting board of the chassis 10 during the installation of the bolt 20. Therefore, a biasing force is provided on the bolt 20, so as to keep the main shaft 21 thereof protruding from the other supporting board not in contact there-with in a default configuration. On the basis of contacting related to the first supporting board 11, the elastic element 30 provides a support to the restricting portion 24 of the main shaft 21, so that the main shaft 21 is usually protruded outside the receiving hole 120 of the second supporting board 12 to lock the piece subject for locking 9. In this embodiment, the elastic element 30 is a compression spring put around the main shaft 21, and is disposed between the first supporting board 11 and the restricting portion 24.

In this embodiment, the restricting portion 24 is connected to the main shaft 21, and protruded from a periphery surface of the main shaft 21. However, the present disclosure is not limited thereto; for example, the main shaft 21 can be divided into a first section and a second section. The first section has a diameter smaller than that of the second section. The restricting portion 24 is disposed on a height difference between the first section and the second section. The elastic element is a compression spring disposed on the first section, and one end of elastic element 30 can be retained therefore.

Please refer to FIG. 2, which is a perspective assembled view of latch assembly with automatic returning bolt according to the present disclosure. When the present disclosure is being assembled, the elastic element 30 is first put around one end of the main shaft 21 far away the lateral-guiding post 22, and against the restricting portion 24. One end of the main shaft 21 having the elastic element 30 is passed through the receiving hole 110 of the first supporting board 11, then the lateral-guiding post 22 is disposed in the guiding slot 130 of the guiding board 13. The guiding slot 130 runs from a top edge of the guiding board 13 downward and then extends along a direction parallel to the main shaft 21. The guiding board 13 has an entrance portion 132 in a funnel shape. The entrance portion 132 is communicated with the guiding slot 130 from the top edge of the guiding board 13. The lateral-guiding post 22 enters into the guiding slot 130 via the entrance portion 132. Finally, the other end of the main shaft 21 enters into the receiving hole 120 of the second supporting board 12. As supplementary note, the receiving holes 110, 120 of this embodiment are shaped correspondingly to a cross-sectional shape of the main shaft 21. However, it is not limited thereto, which can be any shape to restrict the main shaft 21 to move therein.

As supplementary description, the distance between any distal end of the main shaft 21 and the restricting portion 24 is smaller than the distance between the pair of supporting boards 11, 12. The restricting portion 24 is disposed between the handle 26 and the elastic element 30, and is substantially located at the middle of the main shaft 21. Thus, two ends of the main shaft 21 can pass through the pair of supporting boards 11, 12 from the bolt-shifting space S.

Figure 3:
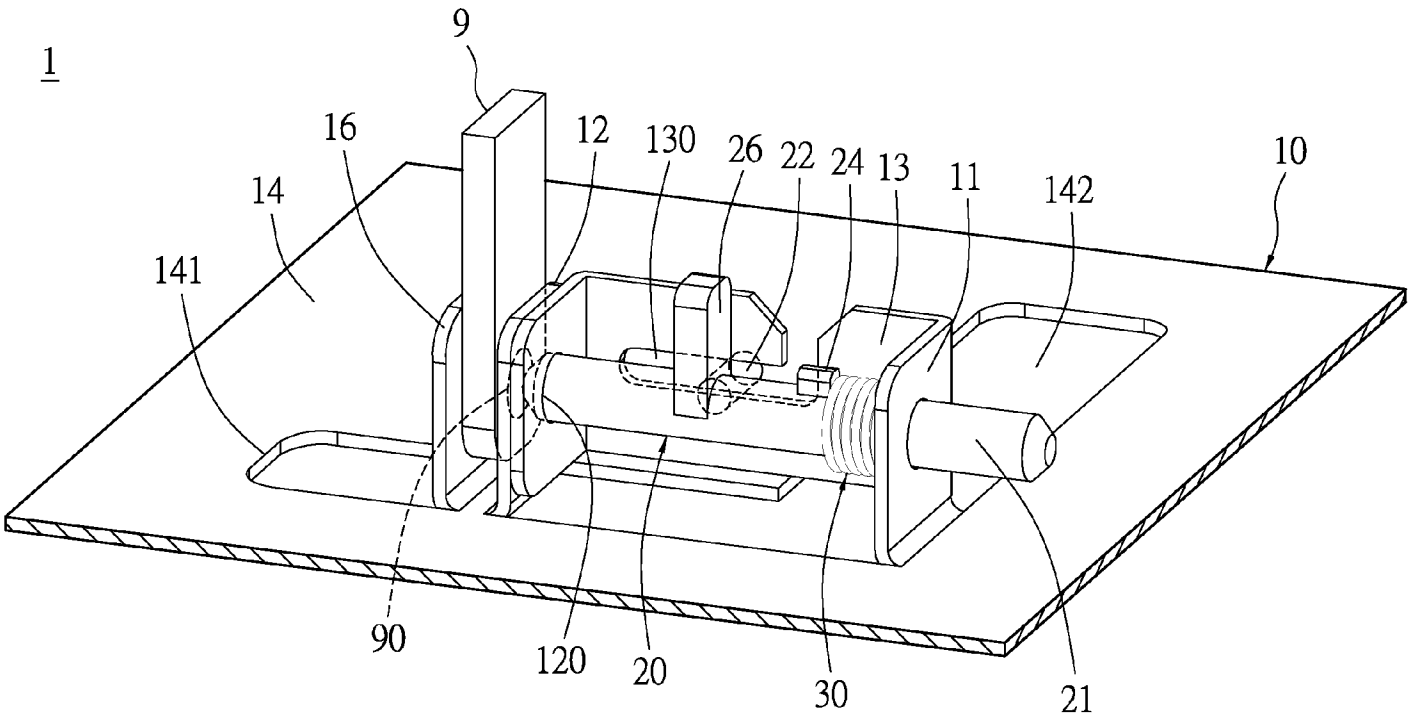
FIG. 3 is a perspective view of the latch assembly with automatic returning bolt and a piece subject for locking in an unlocked condition according to the present disclosure.
Figure 4:
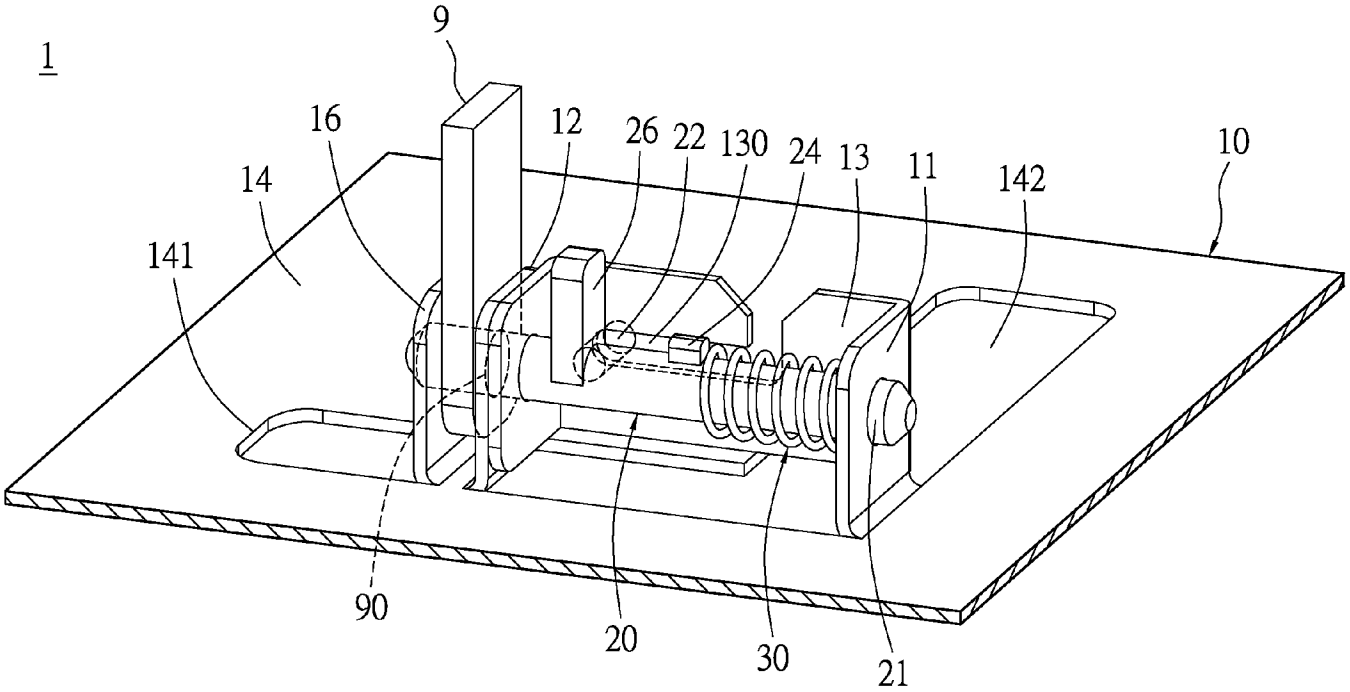
FIG. 4 is a perspective view of the latch assembly with automatic returning bolt and a piece subject for locking in a locked condition according to the present disclosure.

Please refer to FIG. 2 to FIG. 4, which show the processes of the latch assembly with automatic returning bolt to fix the piece subject for locking 9. As shown FIG. 2, the bolt 20 of the latch assembly 1 is withdrawn from the space, or called as locking space, between the blocking board 16 and the second supporting board 12, so that a piece subject for locking 9 can be inserted in the wedging space. The piece subject for locking 9 forms a locked hole 90 for the bolt 20 to be fixed therein. This condition can be achieved when the user pulls the handle 26 to move the main shaft 21 toward the elastic element 30. In the meantime, the elastic element 30 is compressed and a spring force is retained.

Refer to FIG. 3, which is a perspective view of the latch assembly with automatic returning bolt 1 and the piece subject for locking 9 in an unlocked condition of the present disclosure. The piece subject for locking 9 is represented by a board, in practice it can be one part of a casing or housing. The piece subject for locking 9 has been inserted in the locking space between the blocking board 16 and the second supporting board 12. During this process, the user still held the handle 26 of the main shaft 21.

FIG. 4 is a perspective view of the latch assembly 1 and the piece subject for locking 9 in locked condition. After the piece subject for locking 9 is inserted in the locking space, the user releases the main shaft 21. The main shaft 21 moves toward the piece subject for locking 9 by the elastic force of the elastic element 30 and is inserted into the locked hole 90 of the piece subject for locking 9. The motion of the main shaft 21 is limited by the lateral-guiding post 22 and the guiding slot 130 of the guiding board 13 to a linear motion. At this time, the piece subject for locking 9 is locked by the main shaft 21 and cannot move. As shown in FIG. 4, the bolt 20 of latch assembly 1 is in the normal condition according to the present disclosure. The user does not manually move the bolt 20 to a locking position.

Concerning the unlocking processes, it is operated reversely from FIG. 4 to FIG. 2. As shown in FIG. 3, the user pulls the handle 26 toward the elastic element 30 to move the main shaft 21, so that the main shaft 21 withdrawn from the locking space between the blocking board 16 and the second supporting board 12. The piece subject for locking 9 then can be moved upward in an unlocked condition.

In conclusion, the latch assembly with automatic returning bolt of this present disclosure has at least the following advantages.

First, the latch assembly with an automatic returning bolt of the present disclosure uses a simple structure, the bolt and the spring, and can achieve the automatic return of the bolt. Users can quickly dismount without any tool.

Second, the chassis of the present disclosure can be made by punching and bending a metal board, thus the integral chassis of one piece does not need any other assembly procedure. The quantity of element is reduced. The assembly time and human-labor cost are saved. Further, the overall structure is solider.

Third, through the lateral-guiding post cooperated with the guiding board of the chassis, the present disclosure in one aspect can guide the moving direction of the bolt, and in another aspect can restrict the moving stroke of the bolt.

Some modifications of these examples, as well as other possibilities will, on reading or having read this description, or having comprehended these examples, occur to those skilled in the art. Such modifications and variations are comprehended within this invention as described here and claimed below. The description above illustrates only a relative few specific embodiments and examples of the invention. The invention, indeed, does include various modifications and variations made to the structures and operations described herein, which still fall within the scope of the invention as defined in the following claims.

What is claimed is:

1. A latch assembly with automatic returning bolt, comprising:

a chassis having a planar base board formed with a first punching slot and a second punching slot, a pair of supporting boards and a guiding board integrally protruded from the base board, wherein the guiding board is laterally arranged between the pair of supporting boards, wherein a bolt-mounting seat is defined by the pair of supporting boards and the guiding board cooperatively, wherein the pair of supporting boards consist of a first supporting board and a second supporting board, wherein each of the supporting boards is respectively formed with a receiving hole correspondingly positioned to cooperatively define a bolt-shifting space there-between that has a bolt-travel axis, wherein the guiding board is slotted with a guiding slot extending substantially aligningly with the bolt-travel axis;

a bolt having a main shaft, a lateral-guiding post, and a restricting portion laterally arranged on a periphery surface of the main shaft, wherein the main shaft is installed in the bolt-shifting space slidably through the receiving holes of the supporting boards along the bolt-travel axis, wherein as the main shaft slides in the bolt-shifting space, the restricting portion is slidably arranged in the guiding slot, thereby limiting a travel range of the bolt; and wherein the first supporting board is located at a turning place between the first punching slot and the second punching slot, wherein the second supporting board is located above the first punching slot; and an elastic element sleevingly disposed over the main shaft of the bolt, concurrently installed between and in contact with the restricting portion of the bolt and the first supporting board of the chassis, for providing a biasing force on the bolt, so as to keep the main shaft thereof protruding from the second supporting board in a default configuration.

2. The latch assembly with automatic returning bolt as claimed in claim 1, wherein the pair of supporting boards and the guiding board are integrally formed through at least two punched portions located in the punching slots toward the bolt-shifting space, thereby forming the bolt-mounting seat integrally from the base board.

3. The latch assembly with automatic returning bolt as claimed in claim 2, wherein the first punching slot is arranged under the main shaft and the second punching slot is perpendicular to the first punching slot.

4. The latch assembly with automatic returning bolt as claimed in claim 3, wherein the guiding board is bent from one side edge of the first supporting board toward the first punching slot and has a distal end bent changing and overlapping the second supporting board.

5. The latch assembly with automatic returning bolt as claimed in claim 4, further comprising a blocking board bent from a portion of the base board, wherein the blocking board is arranged above the first punching slot parallel to the second supporting board, and an interval is defined between the blocking board and the second supporting board to receive a piece subject for locking.

6. The latch assembly with automatic returning bolt as claimed in claim 5, wherein the blocking board further comprises an outer receiving hole corresponding to the receiving hole of the second supporting board, the main shaft is protruded outside the receiving hole of the supporting board not in contact with the elastic element and passed through the outer receiving hole.

7. The latch assembly with automatic returning bolt as claimed in claim 3, wherein the elastic element is a compression spring put around the main shaft and disposed between the first supporting board and the restricting portion.

8. The latch assembly with automatic returning bolt as claimed in claim 7, wherein the restricting portion is connected to the main shaft and protruded outward from a periphery of the main shaft.

9. The latch assembly with automatic returning bolt as claimed in claim 7, wherein the main shaft has a first section and a second section, wherein the first section has a diameter smaller than that of the second section to form a height difference therebetween, the restricting portion is disposed at the height difference between the first section and the second section, and the elastic element is a compression spring put around the first section.

10. The latch assembly with automatic returning bolt as claimed in claim 1, wherein the guiding slot extends downward from a top edge of the guiding board and through the guiding board in a direction parallel to the main shaft.

11. The latch assembly with automatic returning bolt as claimed in claim 10, wherein the guiding board further includes an entrance portion in funnel-shape, and the entrance portion is communicated with the guiding slot from a top edge of the guiding board.

12. The latch assembly with automatic returning bolt as claimed in claim 1, further comprising a handle connected to the main shaft, wherein the handle is arranged beside the guiding board and extends away from the chassis.

13. The latch assembly with automatic returning bolt as claimed in claim 12, wherein the handle is proximate to the lateral-guiding post and is substantially perpendicular to the lateral-guiding post.

14. The latch assembly with automatic returning bolt as claimed in claim 13, wherein a distance between any distal end of the main shaft and the restricting portion is smaller than the distance between the pair of supporting boards.

* * * * *